United States Patent [19]

Riese

[11] 4,419,802

[45] Dec. 13, 1983

[54] METHOD OF FORMING A HEAT EXCHANGER TUBE

[76] Inventor: W. A. Riese, 23 - 13th St. SW., Massillon, Ohio 44646

[21] Appl. No.: 186,155

[22] Filed: Sep. 11, 1980

[51] Int. Cl.[3] ..... B23P 15/26

[52] U.S. Cl. ..... 29/157.3 A; 165/179; 29/507; 29/523

[58] Field of Search ..... 113/118 R, 118 V, 1 C; 29/523, 455 R, 507, 157.3 AH, 157.3 A, 157.3 B, 157.3 C, 157.4, 157.3 V, 726, 727, 157.3 R; 165/179, 182

[56] References Cited

U.S. PATENT DOCUMENTS

| | | | |
|---|---|---|---|
| 2,693,026 | 11/1954 | Simpelaar | 29/523 |
| 2,778,610 | 1/1957 | Bruegger | 257/262.19 |
| 3,578,075 | 5/1971 | Winter | 165/179 |
| 3,636,607 | 1/1972 | DeMarco | 29/523 |
| 3,730,229 | 5/1973 | D'Onofrio | 165/184 |
| 3,887,004 | 6/1975 | Beck | 29/157.3 A |
| 3,967,840 | 7/1976 | McFall | 29/523 |
| 4,031,602 | 6/1977 | Cunningham et al. | 29/157.3 B |

*Primary Examiner*—Mark Rosenbaum
*Assistant Examiner*—V. K. Rising
*Attorney, Agent, or Firm*—Blair, Brown & Kreten

[57] ABSTRACT

Disclosed herein is a method for forming a heat exchanger tube comprising the steps of inserting an inner tube within an outer tube, interposing therebetween a heat conductive fin element and expanding the inner tube thereby causing frictional engagement of the inner tube, outer tube and interposed fin.

3 Claims, 7 Drawing Figures

METHOD OF FORMING A HEAT EXCHANGER TUBE

BACKGROUND OF THE INVENTION

The ensuing detailed description generally relates to a method for joining inner and outer tubes with fins therebetween so that a heat exchanger tube is provided with benefits in the manufacturing process not contemplated by the prior art.

The following patents appear to be relevant to the patent process and are the closest art of which applicant is aware.

U.S. Pat. No. 2,778,610, Brueggar
U.S. Pat. No. 3,578,075, Winter
U.S. Pat. No. 3,730,229, D'Onofrio
U.S. Pat. No. 3,887,004, Beck
U.S. Pat. No. 4,031,602, Cunningham et al.

Cunningham et al discloses a method of making a heat transfer tube wherein a finned central core is inserted within the interior of an outer tube which is then subjected to an external finning operation to mechanically bond the parts together and to provide fins on the outer surface of the outer tube. The Bruegger patent discloses a method of making a fin tubing in which fins are disposed within grooves formed in an inner tube and compression bands or rings are disposed around the outer edges of the fins and compressed to retain the parts in the assembled condition.

Beck discloses a heat exchanger wherein a finned inner tube having fins of novel cross-sectional configuration are encircled within a tubular shell 38.

The D'Onofrio patent discloses a heat exchanger tube and method for making such a tube wherein an inner tube having external helical fins is disposed within the interior of an outer tube in coaxial reltionship therewith and a finned third tube disposed around the cylindrical outer tube to form a unitary structure. The Winter patent is of general interest in that it shows the forming of a metal tube with spirally wound corrugations for use in a heat exchanger.

By way of contrast, the instant application specifies and is directed to a method for making heat exchanger tubes in which the inner and outer tubes are brought into frictional engagement by the interposing therein of fins having various geometrical configurations and in which the inner tube is expanded outwardly to provide the frictional engagement.

SUMMARY AND OBJECTS OF THE INVENTION

Accordingly, this invention has as an object to provide a method for interconnecting inner and outer tubes having a fin means disposed therebetween so that their relative components are maintained in frictional engagement, by expanding the innermost tube relative to the surrounding tubes.

It is a further object of this invention to provide a method of the character described above which substantially simplifies the means for interconnecting inner and outer tubes for heat exchangers and the like than the prior art would suggest.

It is yet a further object of this invention to provide a method of the character described above in which the quality of the frictional engagement and retention of the inner and outer tubes through the fin means has the highest durability and has relatively inexpensive constructional techniques.

It is yet a further object of this invention to provide a method of the character described above in a tube with internal instead of external fins which would permit air cooled exchangers with the tubes mounted vertically instead of horizontally, and if installed in an air shaft or duct would eliminate the need of blowers or fans with a resultant saving of energy.

A still further object of this invention is to provide a method of the character described above in which automobile radiators could be built in almost any shape and consequently be placed anywhere instead of forward of the engine. A small fan would eliminate the need for the present fan belt drive.

It is a still further object of this invention to provide a method of the character described above in which solar collectors would receive a substantial increase in efficiency. There would be many applications, especially in the liquid cooled units, where application of standard outside fins would increase the heat transfer ability to a great extent.

These and other objects will be made manifest when considering the following detailed specification and when taken in conjunction with the drawing figures wherein it is taught a method for forming inner and outer tubes in frictional engagement having fin means disposed therebetween defined by expanding the inner tube relative to the outer tube and fin so that frictional engagement exists between the various components. Further, other advantages will become apparent when considering the following.

BRIEF DESCRIPTION OF THE DRAWING FIGURES

BRIEF DESCRIPTION OF THE PREFERRED EMBODIMENT

Figure 1:
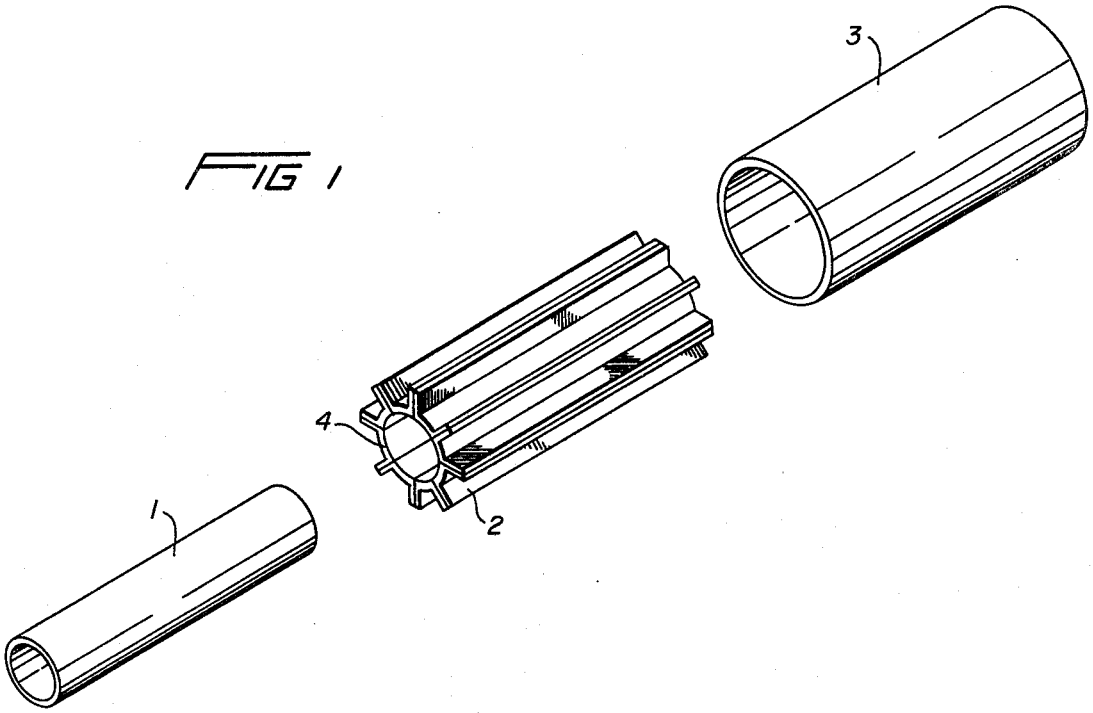
FIG. 1 is a perspective view of the apparatus formed by the method according to the present invention in one form.

Referring to the drawings now wherein like reference numerals refer to like parts of the various drawing figures, reference numeral 1 is directed to the inner cylinder or tube according to the present invention. It is contemplated that the inner tube is to be frictionally engaged with the outer tube 3, by various and sundry methods, those of which will now be delineated.

Figure 2:
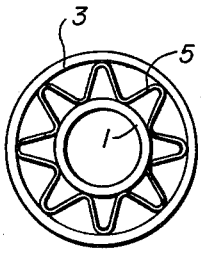
FIG. 2 is an end view of a second possible structure associated with the present method.
Figure 3:
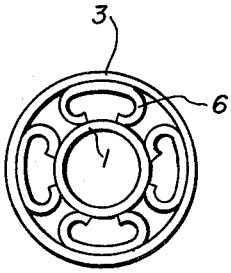
FIG. 3 is a further possible structure associated with the present method.
Figure 4:
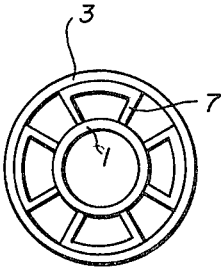
FIG. 4 is a further possible structure associated with the present method.
Figure 5:
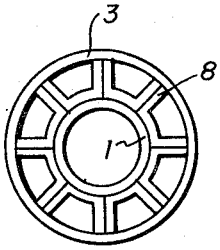
FIG. 5 is a further possible structure associated with the present method.
Figure 6:
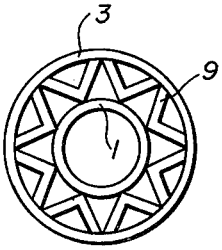
FIG. 6 is a further possible structure associated with the present method.
Figure 7:
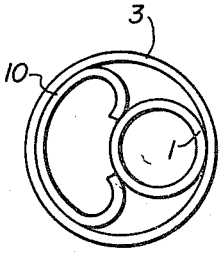
FIG. 7 is a further possible structure associated with the present method.

However, it should be apparent from the drawings, that various types of fins are capable of disposition between the inner and outer tubes, several of which will now be defined through the FIGS. 2–7: the corrugated style of fin 5 as shown in FIG. 2; a C type of fin 3 as shown in FIG. 3; truncated pie shaped fin 7 as shown in FIG. 4; the radially extending segments 8 are shown in FIG. 5, in which two spaced radially extending segments are cut short of the center and interconnected; a further star shaped design or corrugation is shown as in reference numeral 9 FIG. 6; and an enlarged C type of fin 10 similar to that which is shown in FIG. 3 is defined in FIG. 7.

The preferred method for affixing the inner tube with the outer tube through the fins of the heat exchanger comprise a method in which rollers are disposed within the first tube and the rotation of such rollers cause radially expansion of the tube by virtue of the deformation caused by the rollers.

Further methods include placing a mandrel within the inner tube and deforming the pipe outwardly with the mandrel so as to provide the beneficial expansion, another method which has been found to be extremely beneficial is inserting a liquid within the first tube so that there is no air space therewithin, and freezing the liquid so that when the liquid expands due to the freezing, the pipe also expands. A further method contemplates a source of hydraulic pressure to the interior of the first or inner tube and expanding the tube by the pressure. It is also believed that pneumatic pressure could beneficially and expeditously provide radial expansion of the tube along its inner periphery in an uniform manner so as to provide the beneficial frictional engagement of these exchanger tubes.

Further, it should be apparent, that in view of the foregoing, numerous structural modification are contemplated as being a part of this invention as set forth hereinabove and defined hereinbelow by the claims, and that further, numerous methods for expanding the inner tube relative to the outer tube are thought to fall within the scope of this patent as defined hereinbelow by the claims.

What is claimed is:

1. A method of joining inner and outer tubes with fin means therebetween thus forming a heat exchange tube comprising the steps of:

sliding a first tube within a second tube, inserting fin means therebetween, expanding the first tube uniformly along its entire length radially for frictional engagement with the fin means which then causes the fin means ultimately to engage the second tube by expanding thereto, and not allowing the second tube to contract providing thereby a structure of uniform cross section along its entire length and assuring frictional contact of the tubes and fin means along the entire length wherein the first tube is expanded along its entire axial length by inserting a roller type tube expander therein and expanding the first tube radially outwardly with the roller expander along the entire axial length of the first tube.

2. The method of claim 1 including placing the tubes concentrically to each other.

3. The method of claim 1 including placing the tubes asymmetrically relative to each other.

* * * * *